US009554687B2

(12) United States Patent
Brandstetter et al.

(10) Patent No.: US 9,554,687 B2
(45) Date of Patent: Jan. 31, 2017

(54) HOUSEHOLD APPLIANCE AND A CONTROLLING METHOD FOR SUCH A HOUSEHOLD APPLIANCE

(75) Inventors: Florian Brandstetter, Dillingen (DE); Klaus-Martin Forst, Gundelfingen (DE); Erwin Oberstaller, Buttenwiesen (DE)

(73) Assignee: BSH Hausgeräte GmbH, Munich (DE)

( * ) Notice: Subject to any disclaimer, the term of this patent is extended or adjusted under 35 U.S.C. 154(b) by 224 days.

(21) Appl. No.: 13/329,358

(22) Filed: Dec. 19, 2011

(65) Prior Publication Data

US 2013/0133699 A1 May 30, 2013

(30) Foreign Application Priority Data

Nov. 28, 2011 (DE) ..... 10 2011 087 168

(51) Int. Cl.
*A47L 15/42* (2006.01)
*A47L 15/00* (2006.01)

(52) U.S. Cl.
CPC ..... *A47L 15/0049* (2013.01); *A47L 15/0031* (2013.01); *A47L 15/4225* (2013.01); *A47L 2401/06* (2013.01); *A47L 2401/20* (2013.01); *A47L 2501/05* (2013.01)

(58) Field of Classification Search
CPC ..... A47L 15/4225; A47L 2501/05; A47L 15/0049; A47L 15/4204; D06F 39/085
USPC ... 134/25.2, 58 D, 10, 104.2, 18, 186, 56 D; 417/279
See application file for complete search history.

(56) References Cited

U.S. PATENT DOCUMENTS

2005/0005952 A1 1/2005 Bashark
2008/0163930 A1 7/2008 Ha

FOREIGN PATENT DOCUMENTS

EP 2009165 A1 12/2008
WO 2010115685 A1 10/2010
WO WO 2010115685 A1 * 10/2010

OTHER PUBLICATIONS

Kraenzle et al., "Water-conducting household appliance, particularly a dishwasher" Machine Translation, WO 2010115685.*
European Search Report EP 12 19 3307 dated Apr. 1, 2016.

* cited by examiner

*Primary Examiner* — David Cormier
*Assistant Examiner* — Thomas Bucci
(74) *Attorney, Agent, or Firm* — Michael E. Tschupp; Andre Pallapies

(57) ABSTRACT

A household appliance includes a circulation pump for circulating dishwashing liquid in a washing compartment of the household appliance. A drain pump empties the dishwashing liquid from the washing compartment. For the purposes of ventilating the drain pump, a control device is provided to activate the drain pump after the washing compartment has been filled with the dishwashing liquid and before or during operation of the circulation pump.

13 Claims, 3 Drawing Sheets

HOUSEHOLD APPLIANCE AND A CONTROLLING METHOD FOR SUCH A HOUSEHOLD APPLIANCE

BACKGROUND OF THE INVENTION

The present invention relates to a household appliance, for example a dishwasher, and a controlling method for such a household appliance.

A dishwasher has a circulation pump for recirculating dishwashing liquid in the washing compartment of the dishwasher and a drain pump for emptying soiled dishwashing liquid from the washing compartment. Technically important aspects of the pumps used are that they are quiet in operation and extremely efficient.

The drain pump, which can also be called a discharge pump, is connected to a pump well on the intake side. The drain pump also has a chamber in which a pump wheel operates. In an upper region, the pump chamber is connected with the pump well via a ventilation opening. In this way, any gas collecting above a column of residual liquid after the pump wheel has been switched off can escape via the ventilation opening in the pump well so that the drain pump is ventilated. As a result, the pump wheel plunges deeper into the residual dishwashing liquid. Then, when it is switched on again, the drain pump attains maximum efficiency in a relatively short time and while operating quietly.

A water conducting appliance with a pump and a possibility of ventilating this pump is described in DE 10 2009 002 224 A1. The pump in the household appliance can convey liquid in a normal operating mode. In addition, the pump can be ventilated using a ventilation operating mode that can be activated before the normal operating mode, during which at least part of a gas bubble can be conveyed against the direction of conveyance and in normal operating mode, from a pump chamber of the pump to an inlet for liquids of the pump.

BRIEF SUMMARY OF THE INVENTION

Against this background, one object of the present invention is to create means of ventilation for a drain pump of a household appliance.

According to the invention, a household appliance, specifically a dishwasher, is proposed, which has a circulation pump for recirculating dishwashing liquid in a washing compartment of the household appliance, a drain pump for emptying the dishwashing liquid from the washing compartment and a controlling means. For the purposes of ventilating the drain pump, the controlling means is configured to activate the drain pump after the washing compartment has been filled with the dishwashing liquid and before or during operation of the circulation pump.

During this process the chamber of the drain pump, in particular, is ventilated by the drain pump's activation according to the invention.

An advantage of the present invention is the fact that the ventilation of the drain pump is brought forward, and is carried out before any dirt accumulates, so the ventilation process can function reliably.

This prevents dirt from accumulating in sufficient amounts to prevent the said gas bubble in the chamber of the drain pump from being carried away before reuse of the drain pump. As a result, the occurrence of such a fault in the pumping-out process can be reliably prevented. Such a fault in the pumping-out process could cause the appliance to be overfilled, which could lead to water escaping via the edge of the skirt. However, such a fault in the pumping-out process is prevented if the chamber of the drain pump is almost completely ventilated by a short stroke of the pump as soon as it is filled and before activation of the circulation pump, as described above, as at this point no significant dirt removal can have taken place and no significant dirt load can be present before reuse. Activation of the drain pump is thus optimized in that water loss is minimized or prevented altogether. In addition, the probability of occurrence of the fault in the pumping-out process is reduced. Furthermore, the efficiency of the pumping-out process is maximized from the moment pumping out starts.

Reliable operation of the drain pump, including when there is a high accumulation of dirt, can be assured by the ventilation process according to the invention, without the possible disadvantages of higher water consumption having to be taken into account.

The drain pump can also be called a discharge pump. Also, the circulation pump can be called a heat pump.

According to one embodiment, for the purposes of ventilating the drain pump, the controlling means is configured to activate the drain pump for a defined length of time of between 2 and 5 seconds, after the washing compartment has been filled with the dishwashing liquid and before or during operation of the circulation pump. The length of time is preferably between 2.5 and 3.5 seconds, for example 3 seconds.

As a consequence, the drain pump is briefly activated in such a way that although the length of time it is switched on is sufficient to remove the air bubble from the chamber of the drain pump, loss of water from the appliance is still minimized or prevented. Tests carried out by the applicant have shown that an activation time of between 2 and 5 seconds, and 3 seconds in particular, is optimal for the pump stroke.

According to another embodiment, the controlling means is configured to set the length of time during which the drain pump is switched on after the washing compartment has been filled with the dishwashing liquid and before or during operation of the circulation pump on the basis of a predetermined conveying characteristic of the drain pump.

For the purposes of ventilating the drain pump, the controlling means selects the length of time the drain pump is to be switched on specifically on the basis of the type of drain pump used. The present invention can thus be used for many different types of drain pump.

According to a further embodiment, for the purposes of ventilating the drain pump, the controlling means is configured to activate the drain pump after each filling of the washing compartment with the dishwashing liquid and before or during operation of the circulation pump.

By ventilating the drain pump after each filling of the washing compartment with the dishwashing liquid the efficiency of the present drain pump is maximized.

According to a further embodiment, for the purposes of ventilating the drain pump, the controlling means is configured to activate the drain pump between the filling of the washing compartment with dishwashing liquid and activation of the circulation pump.

According to a further embodiment, for the purposes of ventilating the drain pump, the controlling means is configured to activate the drain pump in such a way that dishwashing liquid is pumped out of the washing compartment after the washing compartment has been filled with dishwashing liquid and before or during operation of the circulation pump.

The ventilation stage can thus be combined with the pumping-out process in that, at the start of a corresponding stage, a greater quantity of dishwashing liquid can be introduced into the appliance, and dishwashing liquid corresponding to the quantity of liquid required for the next stage can then be pumped out. In this way, the drain pump is ventilated and any further dirt that accumulates is removed from the drain pump as a result of a longer activation time.

According to a further embodiment, for the purposes of ventilating the drain pump, the controlling means is configured to activate the drain pump after the washing compartment has been filled with the dishwashing liquid and during operation of the circulation pump.

In this way, the drain pump can be ventilated directly after the filling process, including when in simultaneous operation with the circulation pump. Also, the activations of the drain pump and the circulation pump are coordinated with one another in a noise-optimized manner.

According to a further embodiment, the controlling means is configured to control the drain pump and the circulation pump.

According to a further embodiment, the controlling means is implemented as part of the controller of the household appliance.

The controlling means can be implemented in the hardware or the software. When it is implemented in the hardware, the controlling means can be configured as a device such as a computer, a microprocessor or a feature, or as part of the controller of the household appliance. When it is implemented in the software, the controlling means can be configured as a computer program product, a function, a routine, as part of a program code or as an executable object.

Also proposed is a method of controlling a household appliance, specifically a dishwasher, which comprises a circulation pump for circulating dishwashing liquid in the washing compartment of the household appliance and a drain pump for emptying the dishwashing liquid from the washing compartment. In this method, for the purposes of ventilating the drain pump, the drain pump is activated after the washing compartment has been filled with the dishwashing liquid and before or during operation of the circulation pump.

In one embodiment, the method involves pumping the dishwashing liquid out of the washing compartment, filling the washing compartment with fresh dishwashing liquid, activating the drain pump in order that it ventilates itself and then switching on the circulation pump.

In another embodiment, the above sequence of steps is executed cyclically.

In addition, a computer program product is proposed that causes a method for controlling a household appliance to be executed in a program-controlled feature.

The computer program product, for example a computer program tool, can be provided or supplied as, for example, a storage medium such as a memory card, a USB stick, a floppy disk, a CD-ROM, or a DVD, as well as in the form of a file that can be downloaded from a server on a network. This can be on a communications network, for example through the transfer of a corresponding file containing the computer program product or computer program tool.

BRIEF DESCRIPTION OF THE DRAWINGS

Other advantageous embodiments or aspects of the invention are the subject of the subclaims and of the exemplary embodiments of the invention described below. The invention is also described in more detail below using preferred embodiments and with reference to the attached figures, in which:

DETAILED DESCRIPTION OF EXEMPLARY EMBODIMENTS OF THE PRESENT INVENTION

In the figures, reference signs that are the same denote the same or similar components unless otherwise indicated.

Figure 1:
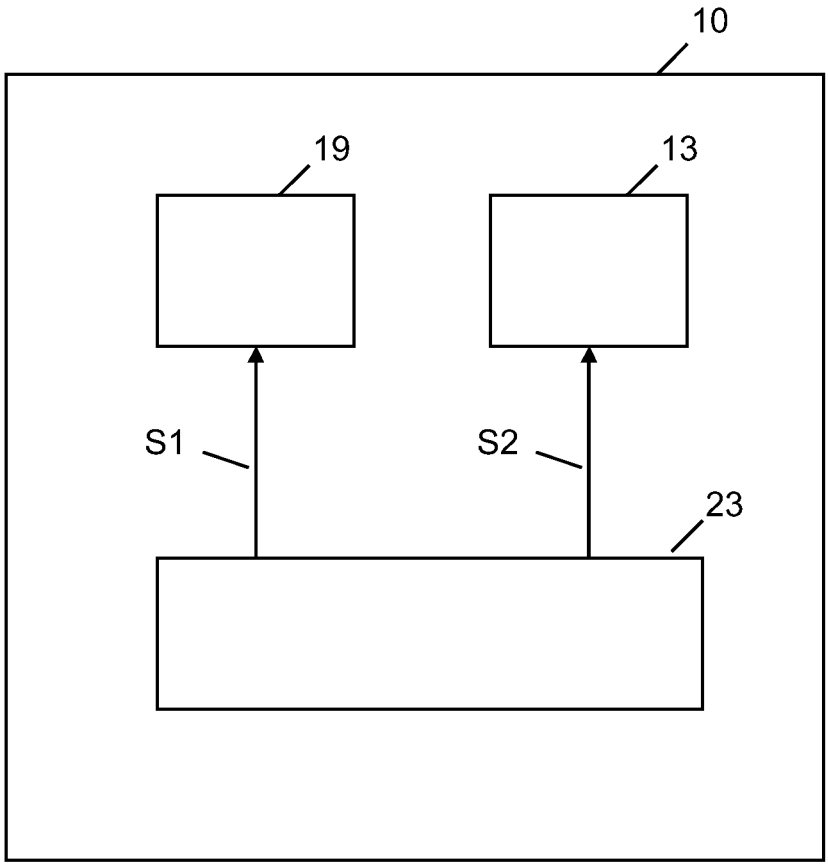
FIG. 1 shows a schematic view of a first exemplary embodiment of a dishwasher.

FIG. 1 represents a schematic view of a first exemplary embodiment of a dishwasher 10.

The dishwasher 10 has a circulation pump 13 and a drain pump 19. The circulation pump 13 can be used to circulate dishwashing liquid in the washing compartment 1 (see FIG. 4) of the dishwasher 10. The drain pump 19 can be used to empty the dishwashing liquid from the washing compartment 1. For the purposes of ventilating the drain pump 19, the controlling means 23 is configured to activate the drain pump 19 after the washing compartment 1 has been filled with the dishwashing liquid 1 and before or during operation of the circulation pump 13. This means that the controlling means 23 controls the drain pump 19 in such a way that it is ventilated; it is activated after the washing compartment 1 has been filled and before or during activation of the circulation pump 13.

To this end, the controlling means 23 controls the drain pump 19 by means of a first control signal S1 and the circulation pump 13 by means of a second control signal S2.

For the purposes of ventilating the drain pump 19, the controlling means 23 activates it for a defined length of time of between 2 and 5 seconds. Specifically, this length of time is between 2.5 and 3 seconds. The length of time can be determined by the controlling means 23 on the basis of the drain pump 19 used, and particularly on the basis of the conveying characteristic of the drain pump 19.

In addition, the drain pump 19 is ventilated through being activated by the controlling means 23 after each filling of the washing compartment 1 with dishwashing liquid. For example, the controlling means 23 can also activate the drain pump 19 in such a way that, for the purposes of ventilating the drain pump 19, dishwashing liquid is pumped out of the washing compartment 1 after the washing compartment 1 has been filled with the dishwashing liquid and before or during operation of the circulation pump 13. For example, if, at the stage when the washing compartment 1 is being filled with dishwashing liquid, more dishwashing liquid is introduced than is necessary for the washing process, then, for the purposes of ventilation, a smaller amount of the dishwashing liquid can be pumped out. For example, at the filling stage, four liters of dishwashing liquid are introduced when the quantity of dishwashing liquid required is three liters and one liter is pumped out again at the ventilation stage.

Alternatively, or in addition, ventilation of the drain pump 19 can be triggered by the controlling means 23 during operation of the circulation pump 13.

The controlling means 23 can also be implemented as part of the controller of the household appliance.

Figure 2:
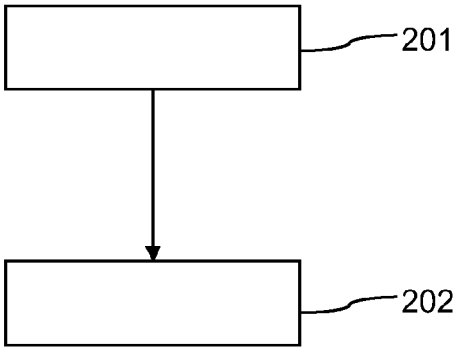
FIG. 2 shows an execution diagram of a first exemplary embodiment of a method of controlling a dishwasher.

FIG. 2 is an execution diagram of a first exemplary embodiment of a method of controlling a dishwasher 10.

Figure 4:
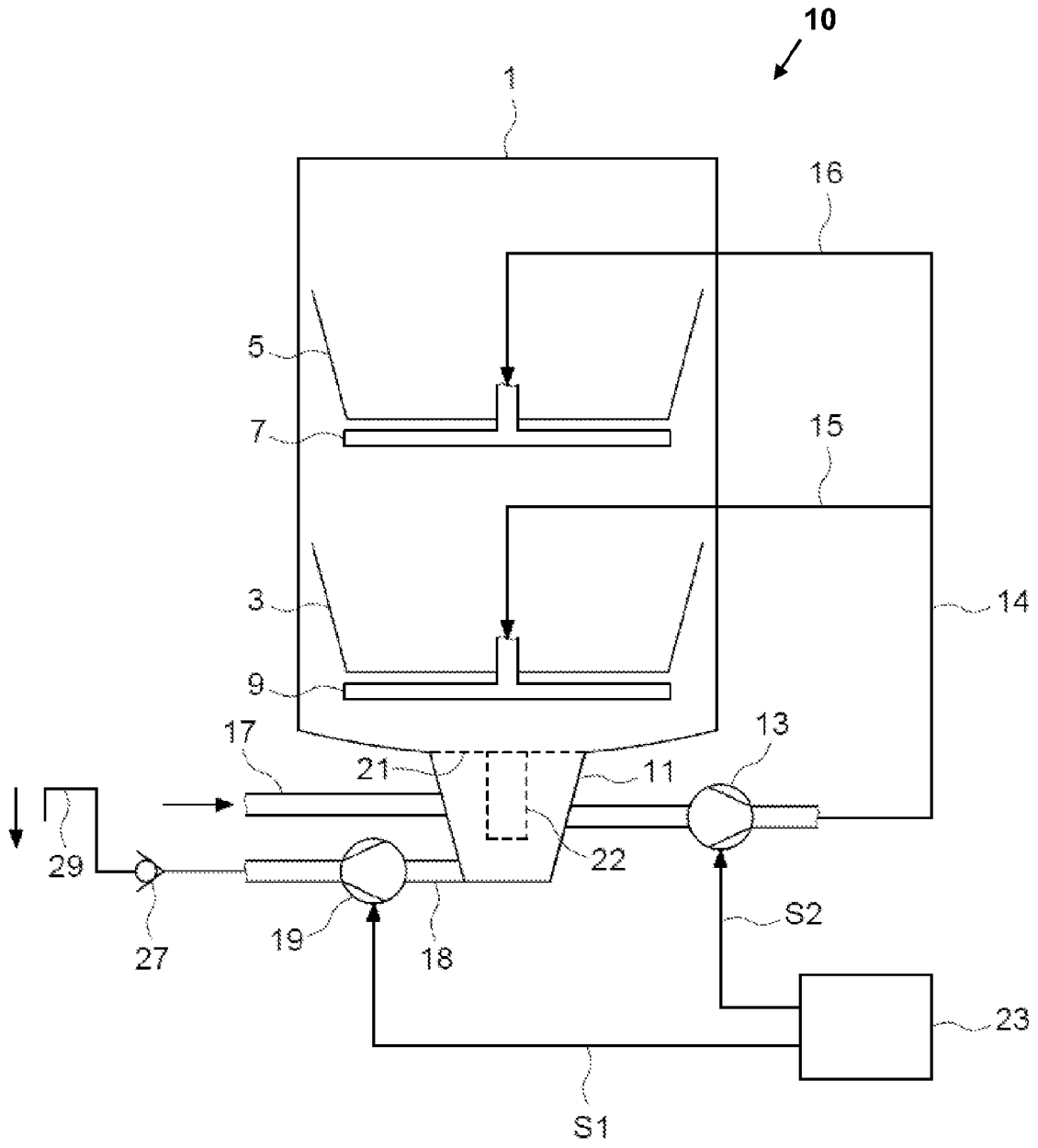
FIG. 4 shows a schematic view of a second exemplary embodiment of a dishwasher.

In step 201, a dishwasher 10 is provided that has at least one circulation pump 13 for circulating dishwashing liquid in the washing compartment 1 of the dishwasher 10 and a drain pump 19 for emptying dishwashing liquid from the washing compartment 1 (see FIGS. 1 and 4).

In step 202, for the purposes of ventilating the drain pump 19, the latter is activated after the washing compartment 1 has been filled with dishwashing liquid and before or during operation of the circulation pump 13.

Figure 3:
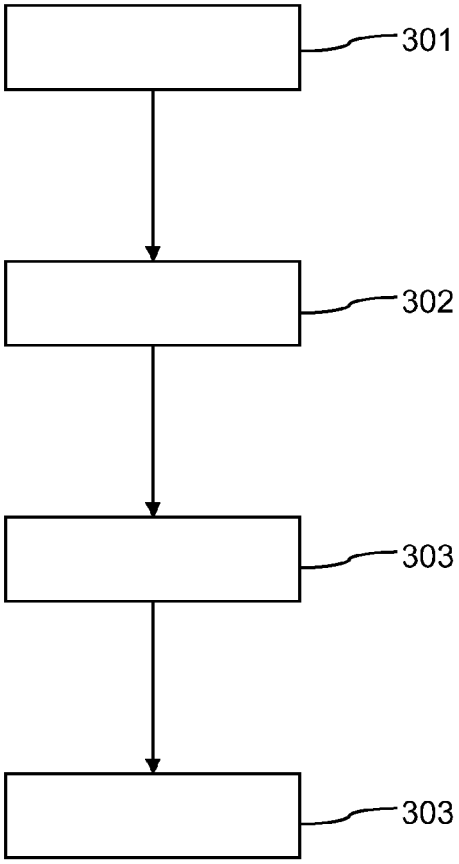
FIG. 3 shows an execution diagram of a second exemplary embodiment of a method of controlling a dishwasher.

FIG. 3 is an execution diagram of a second exemplary embodiment of a method of controlling dishwasher 10.

In step 301, the soiled dishwashing liquid remaining in the washing compartment 1 is pumped out.

In step 302, washing compartment 1 is filled with fresh dishwashing liquid.

In step 303, the drain pump 19 is activated in such a way that it is ventilated.

In step 304, the circulation pump 13 is activated in order that the dishwashing liquid circulates in the washing compartment 1 for the purpose of washing the items introduced into the dishwasher to be washed. After the wash cycle has ended, and thus after the circulation pump 13 has been deactivated, the process starts again with process step 301. It is therefore preferable for steps 301, 302, 303 and 304 to be executed cyclically.

FIG. 4 is a schematic view of a second exemplary embodiment of a dishwasher 10.

The dishwasher 10 has a washing compartment 1 in which items to be washed (not shown) can be arranged in baskets 3, 5. In the washing compartment 1 shown, for example, two spray arms 7, 9 arranged at different spraying levels are provided as examples of sprayers with which dishwashing liquid is applied to the items to be washed. In the floor of the washing compartment is a pump well 11 with a corresponding circulation pump 13 that connects the flow of dishwashing liquid to the spray arms 7, 9 via liquid lines 14, 15, 16.

In addition, the pump well 11 is connected to a fresh water inlet pipe 17 that is connected to the external water supply, as well as to an outlet pipe 18, to which the drain pump 19 for pumping out soiled dishwashing liquid from the washing compartment 1 is connected. Also, a non-return valve 27 is fitted downstream from the discharge pump 19. Downstream from the non-return valve 27 is a siphon section 29 in the waste pipe, with converging vertical sections of pipe, so that a liquid column of a predefined height creates liquid pressure in the reverse-biased direction to the non-return valve 27.

A filter system for cleaning the dishwashing liquid that circulates within the hydraulic circuit is provided in the pump well 11. The filter system has a two-dimensional, funnel shaped fine mesh filter 21 that sits on the upper side of the pump well 11 and a hollow, cylindrical, well-shaped coarse meshed filter 22 that sits in the middle of the pump well 11.

During a wash cycle of the dishwasher 10 the operation of the pumps 13, 19 and of other appliance components not shown here is controlled by the controlling means 23. A wash cycle can have individual program stages in which liquid may or may not be used, such as Pre-rinse, Wash, Intermediate Rinse, Rinse and Dry.

Between two successive program stages in which liquid is used, for example between Pre-rinse and Wash, the dishwashing liquid is changed. When the dishwashing liquid is changed the soiled dishwashing liquid that is no longer needed is drained from the washing compartment 1 into the external drainage network by activation of the drain pump 19. In addition to this, fresh water is fed into the pump well via the fresh water inlet pipe.

The drain pump 19 can be activated during the wash cycle before a change of liquid that takes place after the execution of an individual program stage, such a Pre-rinse, and before the start of the program stage that follows it, for example Wash. A gas bubble trapped in the pump chamber could increase the length of time before the drain pump 19 operates at maximum efficiency. The gas bubble is therefore displaced from the pump chamber by means of the ventilation process described with reference to FIGS. 1 to 3. The ventilation of the drain pump 19 takes place directly after the washing compartment 1 is filled with dishwashing liquid and before activation of the circulation pump 13.

Although the present invention has been described using exemplary embodiments, it can be modified in many ways.

What is claimed is:

1. A household appliance, comprising:

a washing compartment;

a circulation pump for circulating dishwashing liquid in the washing compartment;

a drain pump for emptying dishwashing liquid from the washing compartment; and a control device configured to activate the circulation pump and drain pump in program steps of a wash cycle and to ventilate the drain pump in each program step after the washing compartment has been filled with dishwashing liquid and before operation of the circulation pump.

2. The household appliance of claim 1, constructed in the form of a dishwasher.

3. The household appliance of claim 1, wherein the control device is configured to activate the drain pump for ventilation thereof for a defined length of time of between 2 and 5 seconds.

4. The household appliance of claim 1, wherein the control device is configured to activate the drain pump for ventilation thereof for a defined length of time of between 2.5 and 3.5 seconds.

5. The household appliance of claim 1, wherein the control device is configured to activate the drain pump for ventilation thereof for a defined length of time of 3 seconds.

6. The household appliance of claim 1, wherein the control device is configured to set a length of time for activating the drain pump for ventilation thereof on the basis of a predefined conveying characteristic of the drain pump.

7. The household appliance of claim 1, wherein the control device is configured to activate the drain pump for ventilation thereof after each filling of the washing compartment with the dishwashing liquid and before or during operation of the circulation pump.

8. The household appliance of claim 1, wherein the control device is configured to activate the drain pump for ventilation thereof between filling of the washing compartment with the dishwashing liquid and activation of the circulation pump.

9. The household appliance of claim 1, wherein the control device is configured to activate the drain pump for ventilation thereof in such a way that dishwashing liquid is pumped out of the washing compartment after the washing compartment has been filled with dishwashing liquid and before or during operation of the circulation pump.

10. The household appliance of claim 1, wherein the control device is configured to activate the drain pump for ventilation thereof after the washing compartment has been filled with dishwashing liquid and before or during operation of the circulation pump.

11. The household appliance of claim 1, wherein the control device is configured to control the drain pump and the circulation pump.

12. The household appliance of claim 1, wherein the control device is configured as controller of the household appliance.

13. A household appliance, comprising:

a washing compartment;

a circulation pump for circulating dishwashing liquid in the washing compartment;

a drain pump for emptying dishwashing liquid from the washing compartment; and a control device configured to activate the circulation pump and drain pump and to ventilate the drain pump during a wash cycle before a change of liquid that takes place after an execution of an individual program stage as well as before the start of a next individual program stage that follows the individual program stage.

* * * * *